US010629352B2

(12) United States Patent
Stefanutti et al.

(10) Patent No.: US 10,629,352 B2
(45) Date of Patent: Apr. 21, 2020

(54) TRACTION TRANSFORMER

(71) Applicant: ABB Schweiz AG, Baden (CH)

(72) Inventors: Philippe Stefanutti, Choisy (FR); Stephane Isler, Contamine sur Arve (FR); Toufann Chaudhuri, Morges (CH); Blaise Thorens, Geneva (CH); Luc Grosjean, Chêne-Bougeries (CH)

(73) Assignee: ABB Schweiz AG, Baden (CH)

( * ) Notice: Subject to any disclaimer, the term of this patent is extended or adjusted under 35 U.S.C. 154(b) by 590 days.

(21) Appl. No.: 15/457,141

(22) Filed: Mar. 13, 2017

(65) Prior Publication Data

US 2017/0186524 A1 Jun. 29, 2017

Related U.S. Application Data

(63) Continuation of application No. PCT/EP2015/070962, filed on Sep. 14, 2015.

(30) Foreign Application Priority Data

Sep. 12, 2014 (EP) ..... 14184628

(51) Int. Cl.
*H01F 27/30* (2006.01)
*H01F 27/06* (2006.01)
(Continued)

(52) U.S. Cl.
CPC ..... *H01F 27/06* (2013.01); *B61C 3/00* (2013.01); *B61C 17/00* (2013.01); *H01F 27/025* (2013.01);
(Continued)

(58) Field of Classification Search
CPC ..... H01F 27/26
(Continued)

(56) References Cited

U.S. PATENT DOCUMENTS 2,784,384 A * 3/1957 Vance ..... H01F 27/33 336/100
3,467,932 A * 9/1969 Feather ..... H01F 27/303 336/197
(Continued)

FOREIGN PATENT DOCUMENTS

CN 1758387 A 4/2006
CN 2775812 Y 4/2006
(Continued)

OTHER PUBLICATIONS

European Patent Office, International Search Report & Written Opinion issued in corresponding Application No. PCT/EP2015/070962, dated Feb. 3, 2016, 14 pp.
(Continued)

*Primary Examiner* — Ronald Hinson
(74) *Attorney, Agent, or Firm* — Taft Stettinius & Hollister LLP; J. Bruce Schelkopf

(57) ABSTRACT

The invention relates to a traction transformer for railbound vehicles comprising: an insulating liquid filled enclosure, at least two windings contained in the enclosure, a transformer core, mounting means for mounting the transformer to the railbound vehicle, wherein the transformer core is arranged outside the enclosure, and wherein the mounting means are attached to the transformer core.

21 Claims, 3 Drawing Sheets

(51) Int. Cl.

| | |
|---|---|
| ***H01F 27/28*** | (2006.01) |
| ***H01F 27/26*** | (2006.01) |
| ***B61C 3/00*** | (2006.01) |
| ***B61C 17/00*** | (2006.01) |
| ***H01F 27/02*** | (2006.01) |
| ***H01F 27/34*** | (2006.01) |

(52) U.S. Cl.
CPC ..... *H01F 27/266* (2013.01); *H01F 27/2876* (2013.01); *H01F 27/306* (2013.01); *H01F 27/346* (2013.01)

(58) Field of Classification Search
USPC ..... 336/90, 218, 197
See application file for complete search history.

(56) References Cited

U.S. PATENT DOCUMENTS

| | | | | | |
|---|---|---|---|---|---|
| 3,662,308 | A * | 5/1972 | Muschong | H01F 27/25 | 336/210 |
| 4,631,509 | A * | 12/1986 | Arii | H01F 30/16 | 336/197 |
| 5,289,153 | A * | 2/1994 | Gross | H01F 27/266 | 336/210 |
| 5,594,402 | A * | 1/1997 | Krichtafovitch | H01F 27/266 | 336/65 |
| 5,596,305 | A * | 1/1997 | Puri | H01F 27/327 | 336/205 |
| 2013/0113597 | A1* | 5/2013 | Roy | H01F 27/26 | 336/84 C |
| 2016/0343503 | A1* | 11/2016 | Ueno | H01F 30/08 | |

FOREIGN PATENT DOCUMENTS

| | | | |
|---|---|---|---|
| CN | 200941334 | Y | 8/2007 |
| CN | 201112062 | Y | 9/2008 |
| CN | 102426901 | A | 4/2012 |
| CN | 103326268 | A | 9/2013 |
| CN | 203444944 | U | 2/2014 |
| CN | 103646752 | A | 3/2014 |
| GB | 874730 | A | 8/1961 |
| JP | 2006185624 | A | 7/2006 |
| JP | 52084841 | B2 | 5/2009 |
| JP | 2009117473 | A | 5/2009 |
| JP | 5208481 | B2 | 6/2013 |
| RU | 94756 | U1 | 5/2010 |
| RU | 2012147473 | A | 5/2014 |
| WO | 2014086948 | A2 | 6/2014 |

OTHER PUBLICATIONS

European Patent Office, Extended Search Report issued in corresponding Application No. 14184628.7, dated Mar. 10, 2015, 7 pp.
Kamijo et al., "Fabrication of Superconducting Traction Transformer for Railway Rolling Stock," Journal of Physics: Conference Series 43, 2006, pp. 841-844.
"Compact, lightweight and reliable Traction transformers for rolling stock," ABB Product Brochure, 2011, 4 pp.
China National Intellectual Property Administration; Chinese Office Action dated Mar. 3, 2019; Chinese Application No. 201580042931.1; 28 pgs. (including translation).
The State Intellectual Property Office of the People's Republic of China, First Office Action issued in corresponding Chinese application No. 201580048931.1, dated Sep. 4, 2018, 28 pp.
The State Intellectual Property Office of the People's Republic of China, Second Office Action issued in corresponding Chinese application No. 201580048931.1, dated Feb. 3, 2019, 30 pp.
Federal Service for Intellectual Property, Decision to Grant issued in corresponding Russian application No. 2017112293/07, dated Apr. 24, 2019, 19 pp.

* cited by examiner

TRACTION TRANSFORMER

TECHNICAL FIELD

The present invention relates to the field of traction transformers for electric railway vehicles. It refers to a traction transformer as described in the preamble of claim 1 and 2.

RELATED ART

In electric railway propulsion vehicles such as locomotives or rail coaches, the traction transformer is a crucial piece in the traction chain. If the traction transformer fails, the train is immobilised and a track section is blocked. The traction transformer is the main transformer on the railbound vehicle and provides energy from the catenary to the propulsion motor and for all on board systems. Traction transformers have to accommodate different input frequencies and voltage (ranging from as high as 50 Hz down to 16.7 Hz and rated up to 25 kV) while being suitable for multiple AC asynchronous motor and DC converters and motors with varying harmonics mitigation filtering requirements. To provide high-power conversion the traction transformer need to be designed with a substantial size and weight. A traction transformer is designed to withstand all occurring mechanical vibrations, shocks and acceleration forces of a railway propulsion vehicle.

The traction transformer is usually placed outside the main casing of the traction vehicle, i.e. underfloor or on the roof top where space is limited because of the maximal allowable vehicle height or the available space between underfloor and rail. Tractions transformers may also be placed inside the main casing end prevail similar space limitations. Further, due to considerable weight of the transformer care has to be taken if roof top or underfloor installations are demanded.

The first traction transformers have been constructed with dry in or air insulations causing frequent failures as flashovers and electrical discharges during operation. The failures are caused by dust or humidity to which the transformer was exposed.

Nowadays conventional state of the art traction transformers for electric railway propulsion vehicles are by the type of insulation and cooling oil-immersed transformers to meet the requirements. Oil being a very good heat transfer medium and a good electrically insulating material compared to air, when a high power density is needed. The windings and the core of oil-immersed transformers are completely encased in a tank which is filled with the transformer oil. The tank has therefore appropriate means on its outer side for mounting it to the propulsion vehicle. Such means for mounting are beams, plates etc. which are welded to the tank (housing) of the traction transformer and must take the full weight of tank, transformer and transformer oil. Consequently the tank must have a substantial wall thickness and must be made of heavy weight material as steel to provide the mechanical stability.

Document GB874730 discloses an oil-immersed transformer device for railway propulsion vehicle including the main transformer disposed in transformer tank. The transformer which delivers the required voltage levels for the propulsion is mounted in the transformer tank. The transformer tank is filled with oil. The tank is mounted under the floor of the railway vehicle.

WO2014086948 A2 discloses a transformer for traction applications with windings immersed in an oil filled enclosure. The closed loop core extends through the inner of a central inner cylinder element which forms part of the enclosure and is therefore of contact with oil.

It is an object of the present invention to provide a compact traction transformer design which allows a reduced size and weight while maintaining the required power density.

SUMMARY OF THE INVENTION

This object has been achieved by traction transformer according to claim 1 and 2.

Further embodiments of the present invention are indicated in the depending sub-claims.

According to a first aspect, a traction transformer for railbound vehicles is provided, comprising:

an insulating liquid filled enclosure, at least two windings contained in the enclosure, a transformer core, mounting means for mounting the transformer to the railbound vehicle, wherein the transformer core is arranged outside the enclosure, and wherein the mounting means are attached to the transformer core.

One idea of the above traction transformer is that the windings are housed in the enclosure and the transformer core can pass through the enclosure without being in contact with the insulating liquid and therewith allowing to attach the mounting means directly to the transformer core for mounting the transformer to the railbound vehicle. With other words, the mounting means and the transformer core are directly connected and are in direct physical contact. Forces acting on the railbound vehicle are transmitted directly to the transformer core via the mounting means. On the other hand forces acting on the transformer are transmitted directly from the transformer core to the railbound vehicle via the mounting means. The transformer allows reducing the quantity of insulting liquid filled in the enclosure and simplifying the mechanical structure of the enclosure. Hence, the above traction transformer has reduced size and weight.

Furthermore, the enclosure of the traction transformer is attached to the transformer core by at least two support elements.

It may be provided that the mounting means are solely fixed to the transformer core (40) of the traction transformer. In this way other parts of the transformer, in particular the enclosure of the transformer is not used for fixation of the mounting means. Thereby less quantity of material and more lightweight material can be used for all parts do not contribute to the fixation of the mounting means. Such reduces the total weight of the traction transformer.

Furthermore, the enclosure may be formed by at least one cylindrical inner housing and by a cylindrical outer housing partially surrounding the at least one cylindrical inner housing, wherein an enclosed volume of the enclosure between the at least one cylindrical inner housing and the cylindrical outer housing is filled with the insulating liquid and wherein portions of the transformer core extend through the at least one cylindrical inner housing. The windings enclose the inner cylindrical housing and are supported by the outside surface of the inner cylindrical housing.

It may be provided that a first cover and a second covers are arranged at axial ends of the enclosure. The enclosure is clamped between the at least two support elements pressing at the axial ends onto the first and onto the second cover.

The first cover and the second cover are liquid-tight sealed to the axial ends of the enclosure. Both covers have at least one opening which matches to a diameter of the at least one cylindrical inner housing, in this way a hollow cylinder is formed which contains the insulating liquid. Typically the limbs as part of the transformer core extend through the passage of the hollow cylinder. The liquid-tight sealing may be formed by a glued joint, a gasket or by welding.

Furthermore, the traction transformer is of core-type which means two yokes and two limbs form the core loop. To each of the limbs at least one winding is attached. The yokes extend outside at both axial ends of the enclosure to which the mounting means are fixed.

As the main function of the enclosure is to servers a tank for the insulating liquid and does not serve as fixation of the mounting means, it may be made of a lightweight material. Preferred enclosure materials may be types of glass fiber, epoxy based composite or aluminum.

In may be provided that the mounting means is a mounting frame having sidebars which run in parallel. The sidebars are fixed to the yokes and run parallel to the yoke direction.

Furthermore, stiffening elements may be comprised to absorb forces along the yoke direction and therewith along the moving direction of the railway vehicle. The stiffening elements are attached to the side bars of the frame and to the portion of the transformer which extends through the cylindrical inner housing.

It may be provided the at least two support elements are adapted to the shape of the first cover and the second cover. Those shaped support elements prevent escaping of magnetic stray fields in an axial direction of the windings and the core limbs. Parasitic effects of the stray field to neighboring ferromagnetic parts of the railway vehicle and to the rail causing eddy currents and other losses are reduced.

It may be provided that the enclosure has an eight-shaped cross section perpendicular to the axial direction of the windings. This cross section advantageously improves the mechanical stability of the cylindrical outer housing and therewith of the full enclosure and at the same time reduces the enclosed volume and therewith the quantity of the insulating liquid needed.

BRIEF DESCRIPTION OF THE DRAWINGS

Embodiments will be described in more detail in conjunction with the accompanying drawings, in which.

DESCRIPTION OF EMBODIMENTS

Reference will now be made in detail to the embodiments, one or more examples of which are illustrated in the figures. Each examples provided by way of explanation, and is not meant as a limitation of the invention. Within the following description of the figures, the same reference numbers refer to the same components. Generally, only the differences with respect to individual embodiments are described.

Figure 1:
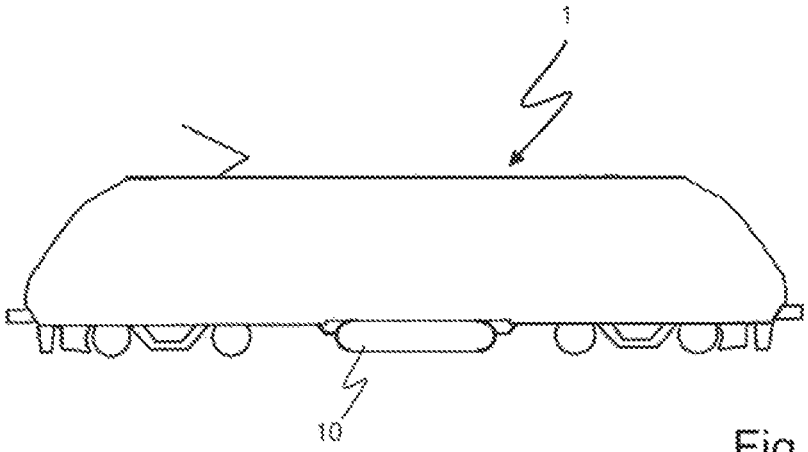
FIG. 1 shows a railbound vehicle with a traction transformer attached underneath the floor of the vehicle casing.

FIG. 1 schematically shows a railbound vehicle 1 equipped with traction transformer 10 attached underneath the floor of the vehicle casing. In other configurations the transformer may be attached on the roof top of the vehicle or maybe attached in the machine room inside the vehicle casing.

In the following a first embodiment of the traction transformer is described in conjunction with the views according to FIGS. 2*a* to 2*d*. The traction transformer 10 comprises an enclosure 20 filled with insulating liquid 205. The insulating liquid typically comprises mineral oil, silicon oil, synthetic or vegetable oil and serves for electrical isolation of the windings and for pooling of the windings.

The enclosure 20 is formed by two cylindrical inner housings 201, 202 and by a cylindrical outer housing 203 surrounding the two cylindrical inner housings 201, 202. Each of the cylindrical inner housings 201, 202 has an annular cross section and has a cylinder axis which is substantially parallel to the cylinder axis of the outer housing 203, which is the axial direction Y as indicted in FIG. 2*d*. The axial direction Y is also the axial direction of the windings 30, 31. The cylindrical inner housings 200, 201 may also be shaped with different cross-sections (across the axial direction Y thereof).

Figure 2A:
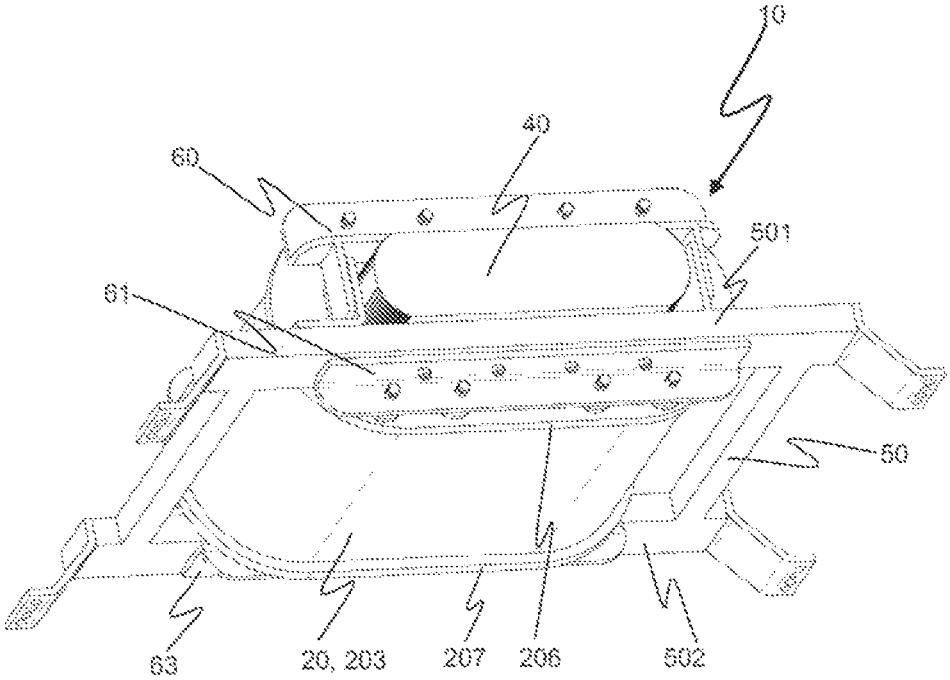
FIG. 2*a* shows a perspective view of a traction transformer for horizontal mounting.
Figure 2B:
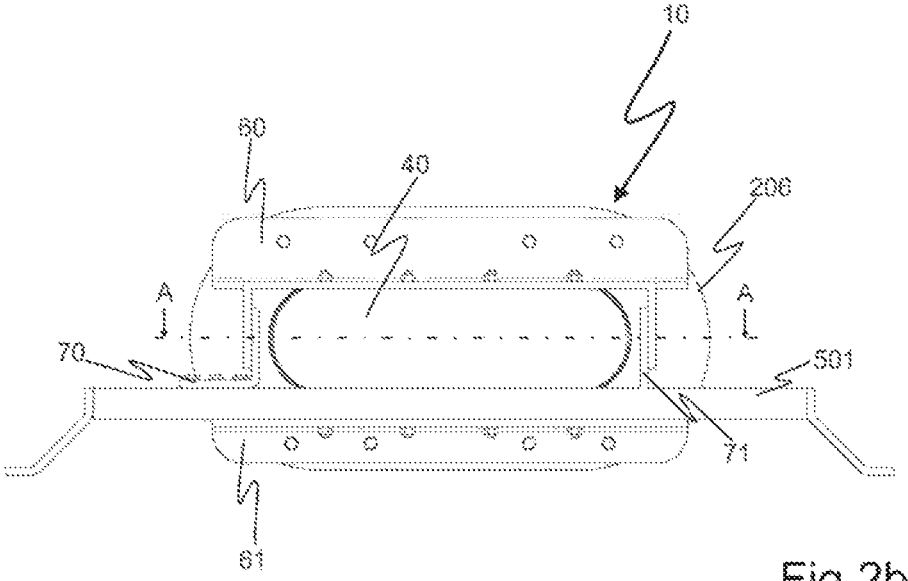
FIG. 2*b* shows a side view of the traction transformer.
Figure 2C:
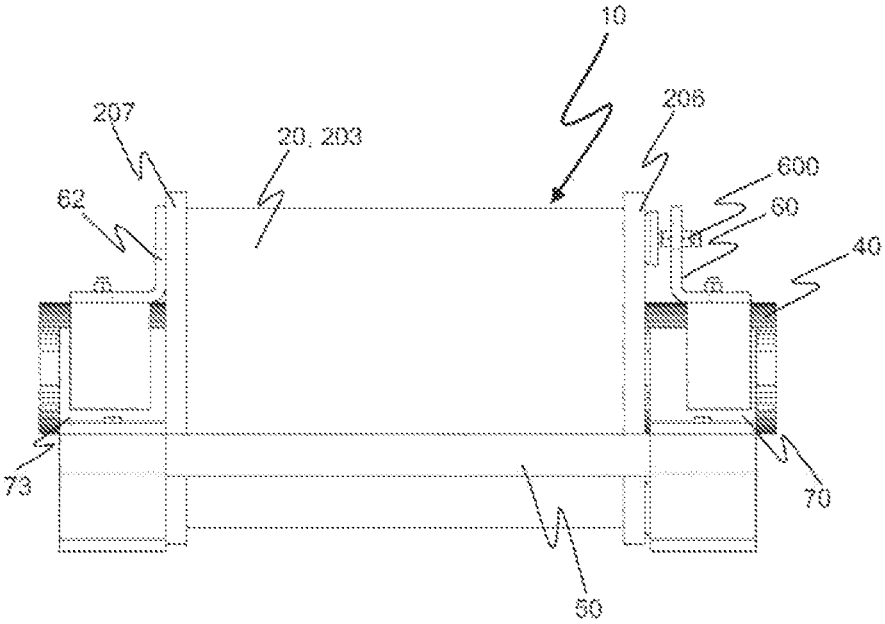
FIG. 2*c* shows another side view of the traction transformer.
Figure 2D:
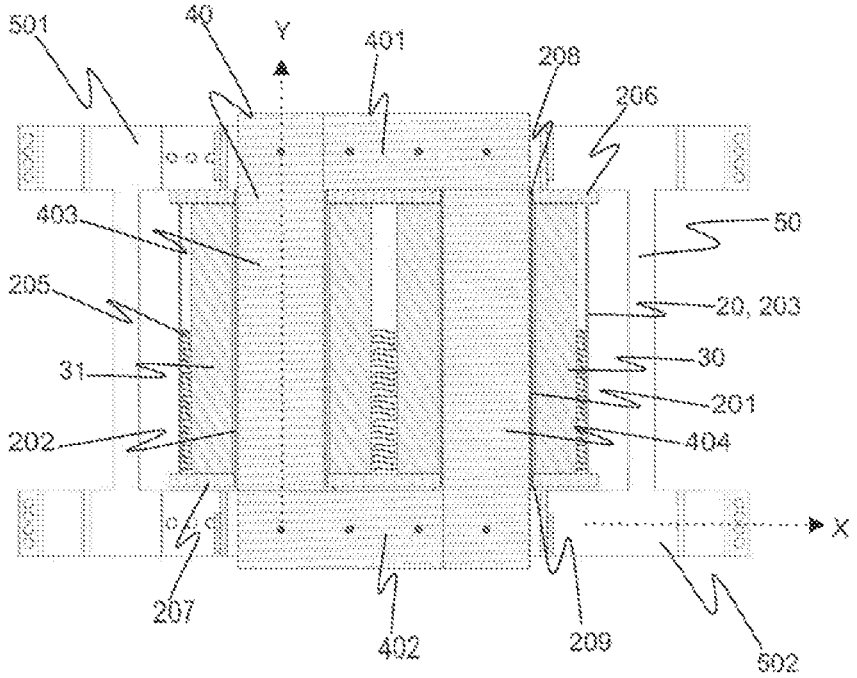
FIG. 2*d* shows-a section view of the traction transformer according to the invention.

Each of both axial ends of the enclosure 20 is closed by a first and a second cover 206, 207 respectively. The first and the second cover 206, 207, the two cylindrical inner housing 201, 202, and the cylindrical outer housing 203 form an enclosed volume which is filled with the insulating liquid 205 in particular with transformer oil. The windings 30, 31 which are accommodated in the enclosure are completely immersed in the transformer oil. Therefore the first and the second cover 206, 207 are liquid-tight sealed to the cylindrical outer housing 203 and to the two cylindrical inner housings 201, 202. The sealing can be made by a glued joint. Alternatively, the sealing may be made by a gasket or by a type of welding, FIG. 2*d* is a section view of FIG. 2*b* taken along the A-A line of the traction transformer 10 according to the first embodiment and shows two circular openings 208, 209 in the first and the second cover 207, 208 respectively which openings 208, 209 match to the inner diameter of the cylindrical inner housing 201. Two further openings are provided and matching to the inner diameter of the cylindrical inner housing 202.

The two limbs 403, 404 of transformer core 40 extend through the two cylindrical inner housings 201, 201 and therewith through the two windings 30, 31. The limbs 403, 404 are bridged by the two transformer yokes 401, 402 at the axial ends of the enclosure 20. In this way a core-type transformer is realized with the windings 30, 31 solely immersed in the transformer oil. The transformer core 40 is outside the enclosure and therefore not in contact with transformer oil and may be called by air.

The windings 30, 31 are wound around the respective cylindrical inner housing 201, 202. The conductors of the winding 30, 31 can be wire-like, such as a coil of metal wire, e. g. copper wire, or plate-like, coated with an electrical insulation layer, and are spirally wound around the cylindrical inner housings 201, 202. The winding 30 may act as a primary winding and the winding 31 may act as a secondary winding of the traction transformer 10 or vice versa.

To avoid a short circuit, the two cylindrical inner housings 201, 202 must not act as a turn of a parasitic secondary coil. Hence, both inner housings 201, 202 are made of electric insulating material for example an epoxy based composite.

For the horizontal mounting of the traction transformer 10 to the railbound vehicle 1 the plane spanned by the X-Y directions is substantially parallel to the roof or to the underfloor of the railbound vehicle 1.

As can be seen from the FIGS. 2*a* to 2*d*, the transformer core 410 is fixed to the mounting means 50 which are embodied as mounting frame. The frame allows a mounting of the transformer 10 onto the roof top or underneath the floor of the train and has two parallel side bars 501, 502 which are welded together by two transverse bars. The side bars 501, 502 are aligned along the train and along the moving direction of the train which is indicted as X-direction. By fixation of the transformer core 40 directly to the frame and therewith to the railbound vehicle the heaviest part beside the windings of the transformer is used for fixation and advantageously acceleration forces or vibrations from train vehicle can be transmitted directly to the transformer core. Such simplifies the mechanical construction of the traction transformer 10 and in particular the construction of its enclosure 20.

The traction transformer 10 is fixed to the frame solely by means of the transformer core 40 which rests on the side bars 501, 502 of the frame. In particular the transformer yokes 401, 402 and the ends of the transformer limbs 403, 404 which protrude beyond the axial ends of the enclosure 20 rest on top of the side bars 501, 502. In other embodiments it may be provided that the frame rest on top of the transformer core 40.

The fixation between the transformer core 40 and the side bars 601, 502 is made by screw joints. To provide a high rigidity and stability between the core 40 and the frame, the transformer core 40 is of stack-lap type in which one or several layers of the limbs 403, 403 overlap with one or several layers of the yokes 401, 402 as it is indicated in FIG. 2*d*. 8 through-holes are provided in the transformer core 40, of which four are made at the four corners of the transformer core 40 in the overlapping region of limbs 403, 404 and the yokes 401, 402. When the transformer core 40 is mounted to the frame by screws then also the limbs are screwed together with the yokes 401, 402. The yokes 401, 402 are oriented parallel to the side bars 501, 502 and therewith along the X-direction.

The frame is mounted by four curved legs to the railbound vehicle 1 which are welded to the ends of the side bars 501, 502.

As can be seen from the FIGS. 2*a* to 2*d*, the enclosure 20 is fixed to the transformer core 40 by four support elements 60, 61, 62, 63 which are angled and in which two of them 60, 62 are arranged on the top of the transformer core 40 at the axial ends of the enclosure 20 and wherein the two other angled support elements 61, 63 are arranged at the bottom side of the transformer core 40 at the axial ends of the enclosure 20.

Each of the angled support elements 60, 61, 62, 63 is screwed by one of its two legs directly to the transformer core 40, whereas the enclosure 20 is clamped between the other legs. Latter ones press at the axial ends onto the first and second cover 206, 207. The support element 60 on the top of transformer core 40 and the support element 61 on the bottom side of the transformer core 40 have adjusting screws to set the contact force for clamping the enclosure 20. The adjusting screws are fixed on the leg of the support element 60, 6*l* which presses against first 206 or the second cover 207.

Each of the yokes 401, 402 of the traction transformer 10 is screwed together with the respective side bar 501, 502 of the frame, with the respective support element 60, 61, 62, 63 on the top of the transformer core and with the respective support element on the bottom side of the transformer 10. The screw joint is arranged perpendicular to the axial direction Y of the windings.

The support elements 60, 61, 62, 63 may be adapted partially or full to the shape of cover first 206 or the second cover 207 (not shown) so as to prevent escaping of the magnetic flux in axial direction Y of the windings. In this way shaped support elements 60, 61, 62, 63 act as shielding and prevent a distraction of the unwanted magnetic stray field to the environment, in particular to the railbound vehicle or the rails.

The traction transformer 10 may be provided with stiffening elements 70, 71, 72, 73 to absorb acceleration forces along the moving direction of the railbound vehicle 1. The stiffening elements 70, 71, 72, 73 are attached to top of the side bars 501, 502 and along the X-direction. The fixation may be made by a screw joint as shown for stiffing element 70 in FIG. 2*b* or may be welded to the side bars, 501, 502 as it is exemplarily indicated for the stiffing element 71 in FIG. 2*b*. The'stiffening elements 70, 71, 72, 73 are positioned before and after the parts of the transformer core 40 which extend beyond the axial ends of the housing 20, which are the yokes 401, 402.

Additional stiffening element may also be attached to the support elements 60, 61, 62, 63 to absorb acceleration forces and are welded thereto. These additional stiffening elements are positioned also before and after the yokes 401, 402, may be screwed to the transformer core 40 and prevent an unwanted movement of the transformer core 40 along the X-direction.

Figure 3:
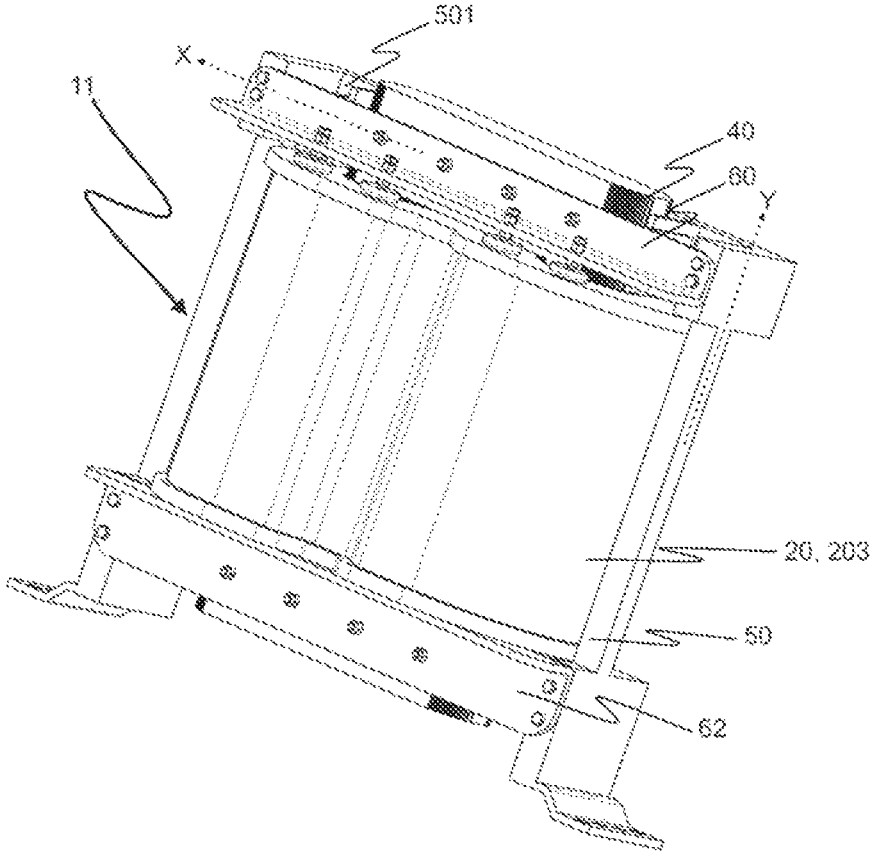
FIG. 3 shows perspective view of a traction transformer for vertical mounting.

FIG. 3 shows a further embodiment of a traction transformer 11 for vertical mounting to the railbound vehicle, suitable to be mounted for example in the machine-room of the vehicle.

The transformer core 40 is fixed to the mounting means 50 which are also embodied as a mounting frame. In difference to the embodiment according to the FIGS. 2*a* to 2*d* the transformer 11 and the mounting means 50 are turned by 90° in a upright position. With other words, the plane spanned by the X-Y directions is substantially perpendicular oriented to the floor of the railbound vehicle and therefore the axis of the windings are oriented vertically. The side bars 501, 502 are welded together with two H-bars which run traverse between the side bars 501, 502 and form the frame.

The cylindrical outer housing 203 has an eight-shaped cross section which provides a higher mechanical stability to the enclosure 20 as compared to a normal cylindrical shaped housing. Thus, a more lightweight material like aluminum instead of steel can be used as material for the cylindrical outer housing 203. The cylindrical outer housing 203 can be made of aluminum which further shows a good heat conductivity compared to steel and improves the heat dissipation from the traction transformer 11 to its environment. It may be also provided to use lightweight material which is electric insulating as for example an epoxy composite, if the heat dissipation over the cylindrical outer housing 203 is not of importance for the design of the traction transformer 11.

The traction transformer 11 has two legs which are welded to the ends of the side bars 501, 502 at the same axial end of the enclosure 20 to mount the transformer in a vertical position to the railbound vehicle 1.

REFERENCE LIST

1 railbound vehicle
10, 11 traction transformer

20 enclosure
30, 31 windings
40 transformer core
50 mounting means
60, 61, 62, 63 support elements
70, 71, 72, 73 stiffening elements
201, 202 cylindrical inner housing
203 cylindrical outer housing
205 insulating liquid
206, 207 first and second covers
208, 209 openings in the first and second cover
401, 402 transformer yokes
403, 404 transformer limbs
501, 502 sidebars
600 adjustment screw
X axial direction of the yoke, direction of the side bars
Y axial direction of the windings and of the cylindrical inner housings

The invention claimed is:

1. A traction transformer for railbound vehicles comprising:

an insulating liquid filled enclosure with a first and a second cover arranged at axial ends of the enclosure, at least two windings contained in the enclosure, a transformer core arranged outside the enclosure, mounting means for mounting the transformer to the railbound vehicle, wherein the mounting means are attached to the transformer core, and wherein the enclosure is clamped between at least two support elements pressing at the axial ends onto the first and the second cover; and wherein the insulating liquid is a transformer oil.

2. The traction transformer according to claim 1, wherein the mounting means are only fixed to the transformer core of the traction transformer.

3. The traction transformer according to claim 1, wherein the enclosure is formed by two cylindrical inner housings and by a cylindrical outer housing partially surrounding the two cylindrical inner housings, wherein an enclosed volume of the enclosure between the two cylindrical inner housings and the cylindrical outer housing is filled with the insulating liquid, and wherein portions of the transformer core extend through the two cylindrical inner housings.

4. The traction transformer according to claim 1, wherein the at least two support elements are adapted to the shape of the first cover and the second cover for preventing a magnetic stray field in an axial direction of the winding, wherein the shaped support elements act as shielding and prevent a distraction of the unwanted magnetic stray field to the railbound vehicle or to the rails.

5. The traction transformer according to claim 1, wherein the enclosure has an eight-shaped cross section, and wherein the cross section being perpendicular to the axial direction of the windings.

6. The traction transformer according to claim 1, wherein the insulating liquid comprises mineral oil, silicon oil, synthetic oil or vegetable oil and serves for electrical isolation of the windings and for cooling of the windings.

7. The traction transformer according to claim 1, wherein the first and the second cover, the two cylindrical inner housings, and the cylindrical outer housing form an enclosed volume which is filled with the insulating liquid, and the windings which are accommodated in the enclosure are completely immersed in the transformer oil.

8. The traction transformer according to claim 1, wherein the enclosure is attached to the transformer core by the at least two support elements.

9. The traction transformer according to claim 8, wherein the enclosure is fixed to the transformer core by four support elements which are angled and in which two of them are arranged on the top of the transformer core at the axial ends of the enclosure and wherein the two other angled support elements are arranged at the bottom side of the transformer core at the axial ends of the enclosure.

10. The traction transformer according to claim 9, wherein each of the angled support elements is screwed by one of its two legs direction to the transformer core, whereas the enclosure is clamped between the other legs, the atter ones press at the axial ends onto the first and second cover, and wherein the support elements on the top of the transformer core and the support element on the bottom side of the transformer core have adjusting screws to set the contact force for clamping the enclosure, and the adjusting screws are fixed on the leg of the support element which presses against the first cover or the second cover.

11. The traction transformer according to claim 1, wherein the first cover and the second cover are liquid-tight sealed to the axial ends of the enclosure and wherein the first cover and the second cover each have at least one opening matching to a diameter of the at least one cylindrical inner housing, and wherein the portions of the transformer core partly extend through the at least one opening.

12. The traction transformer according to claim 11, wherein the liquid-tight sealing is ensured by a glued joint and/or by a gasket and/or by welding.

13. The traction transformer according to claim 11, wherein the mounting means are a frame with parallel sidebars and wherein the sidebars are fixed to the yokes and run along the yoke direction.

14. The traction transformer according to claim 13, wherein the traction transformer comprises stiffening elements to absorb forces along the yoke direction, wherein the stiffening elements are attached to the side bars of the frame and to the portion of the transformer core partly extending through the at least one cylindrical inner housing.

15. The traction transformer according to claim 14, wherein additional stiffening elements are attached to the support elements to absorb acceleration forces and are welded thereto, and the additional stiffening elements are positioned before and after the yokes, in particular are screwed to the transformer core, and prevent an unwanted movement of the transformer core along the X-direction.

16. The traction transformer according to claim 1, wherein the traction transformer is of core-type and the mounting means are fixed to the yokes of the transformer core.

17. The traction transformer according to claim 16, wherein the transformer core is of stack-lap type, and the mounting means, and the at least two support elements are screwed together perpendicular to the axial direction of the windings.

18. The traction transformer according to claim 17, wherein at least four support elements are provided, wherein two of the at least four support elements are screwed together at each axial end of the enclosure, and wherein one of the yokes and one of the sidebars are arranged between the two support elements.

19. The traction transformer according to claim 1, wherein the enclosure comprises a lightweight material, in particular glass fiber, epoxy based composite, or aluminum.

20. The traction transformer according to claim 19, further comprising:

an insulation liquid filled enclosure with a first and a second cover arranged at axial ends of the enclosure;

at least two windings contained in the enclosure;

a transformer core arranged outside the enclosure;

mounting means for mounting the transformer to the railbound vehicle;

wherein the mounting means are attached to the transformer core, wherein the enclosure is formed by two cylindrical inner housings and by a cylindrical outer housing partially surrounding the two cylindrical inner housings, wherein an enclosed volume of the enclosure between the two cylindrical inner housings and the cylindrical outer housing is filled with the insulating liquid, and wherein portions of the transformer core extend through the two cylindrical inner housings, wherein the insulating liquid is a transformer oil;

the enclosure is attached to the transformer core by at least two support elements;

the traction transformer is of core-type and the mounting means are fixed to the yokes of the transformer core; and the transformer core is of stack-lap type, and the mounting means and the at least two support elements are screwed together perpendicular to the axial direction of the windings.

21. A traction transformer for railbound vehicles comprising:

an insulation liquid filled enclosure with a first and a second cover arranged at axial ends of the enclosure; at least two windings contained in the enclosure; a transformer core arranged outside the enclosure; mounting means for mounting the transformer to the railbound vehicle; wherein the mounting means are attached to the transformer core, wherein the enclosure is formed by two cylindrical inner housings and by a cylindrical outer housing partially surrounding the two cylindrical inner housings, wherein an enclosed volume of the enclosure between the two cylindrical inner housings and the cylindrical outer housing is filled with the insulating liquid, and wherein portions of the transformer core extend through the two cylindrical inner housings, wherein the insulating liquid is a transformer oil; the enclosure is attached to the transformer core by at least two support elements; the traction transformer is of core-type and the mounting means are fixed to the yokes of the transformer core; and the transformer core is of stack-lap type, and the mounting means and the at least two support elements are screwed together perpendicular to the axial direction of the windings.

* * * * *